United States Patent [19]

Goodman

[11] Patent Number: 4,472,065

[45] Date of Patent: Sep. 18, 1984

[54] TIME READ-OUT DEVICE FOR ELECTRONIC CLOCKS

[76] Inventor: Joseph Goodman, 2/6 Shderot Eshkol, Jerusalem, Israel

[21] Appl. No.: 358,711

[22] Filed: Mar. 16, 1982

[30] Foreign Application Priority Data

Mar. 27, 1981 [IL] Israel ..... 62499

[51] Int. Cl.[3] ..... G04B 25/00; G04B 21/02; G04B 19/16

[52] U.S. Cl. ..... 368/71; 368/75; 368/230; 368/273

[58] Field of Search ..... 368/62, 69, 71–75, 368/250, 251, 230, 272–273; 340/384 E

[56] References Cited

U.S. PATENT DOCUMENTS 3,938,317 2/1976 Spano ..... 368/62
4,055,843 10/1977 Whitaker ..... 340/384 E
4,078,376 3/1978 Freeman ..... 368/73
4,176,518 12/1979 Kawakami et al. ..... 368/71
4,236,375 12/1980 Komaki ..... 368/73

*Primary Examiner*—Vit W. Miska
*Attorney, Agent, or Firm*—Handal & Morofsky

[57] ABSTRACT

A device for converting pulses generated by a 7-segment, 12-hour clock unit of a standard electronic timepiece into a sequence of nonoptical time-indicating signals. The device comprises binary counter means for counting minutes and groups of 5-minute multiples each, a parallel binary-to-serial pulse converter for converting the parallel hour, 5-minute-multiple and minute signals from the 7-segment display unit and from the counter means respectively, into serial pulses distinctly representing hours, 5-minute multiples and minutes respectively. The device also comprises amplifier means for amplifying the serial pulses and aural or tactile sensation-producing device to render the pulses audible or palpable.

12 Claims, 10 Drawing Figures

TIME READ-OUT DEVICE FOR ELECTRONIC CLOCKS

The present invention relates to a device which, in combination with an electronic timepiece, converts signals from a 7-segment 12-hour clock unit, into a sequence of non-optical time-indicating signals.

Ascertaining the time has always presented a problem to the blind and in the past they have had to rely exclusively on their sense of touch to tell the time. To this end, the crystal had to be openable, to permit the blind person to touch the watch hands as well as the Braille markings on the edge of the watch face, a procedure neither convenient for the operator nor conducive to ascertaining the correct time. Attempts have therefore been made, especially since the development of miniaturizable electronic components, to develop methods and devices for telling the time that, if based on the tactile sense, would not demand as great a delicacy of touch as did the conventional method or, still better, did not involve the tactile sense at all, being based on the sense of hearing, that is, producing audible signals containing the required information.

In U.S. Pat. No. 4,055,843—Whitaker, there is disclosed a system whereby electronic digital clocks may announce the exact time every ten minutes. Whitaker proposes the use of audio signals indicating hours and tens of minutes. This device uses a binary display: 4 pulses for the hour and three pulses for the minutes. The disadvantages of this device are obvious: it has no "on demand" features, providing time information only once every ten minutes, which is clearly insufficient for practical use. A further disadvantage is its use of a binary code which is neither generally known or easily learned.

Another device, by Kawakami, U.S. Pat. No. 4,176,518 proposes a time signal clock which indicates time by moving a pointer with a motor drive, while giving time signals by sound. The Kawakami device is an analog clock having a large number of mechanical parts, in itself a disadvantage at a time when development is away from mechanical and analog clocks, towards purely electronic as well as digital clocks. As is the case with the Whitaker device, the Kawakami clock has no "on demand" feature and the intervals between time announcements are even larger than with the Whitaker prior art.

Yet another device has been disclosed by Spano in U.S. Pat. No. 3,938,317, which provides electronic or electromechanical means for enabling a person with a visual handicap to tell the time by means of a serial readout. From perusal of the above patent, it appears that the Spano timepiece has no visual display at all, time information being obtainable solely through the senses of hearing and/or touch. A most serious disadvantage of the Spano device is the fact that it converts binary signals into an audible or palpable dot-dash code of hours, tens of minutes and minutes, which bear no relationship to the numerals they represent (except for the numerals 1, 2 and 3). This code is very complex and requires much study as well as practice. The user of the Spano device, wishing to ascertain the time, would have to translate each code unit into the numeral it represents and memorize it—all during the 2,4-sec interval between separate code units—and then compute the sum total into time.

It is an object of the present invention to overcome the drawbacks and disadvantages of the prior-art devices and to provide a device which, on demand, converts the display in an electronic timepiece from the 7-segment unit into audible and/or tactile symbols, each of which stands for a discrete unit of time, and which merely have to be counted, to obtain the time.

This the invention achieves by providing, in combination with the 7-segment, 12-hour clock unit of a standard electronic timepiece, a device converting pulses, generated by said 12-hour clock unit, into a sequence of nonoptical time-indicating signals, comprising binary counter means for counting minutes and groups of 5-minute multiples each, a parallel binary-to-serial pulse converter for converting the parallel hour, 5-minute multiple and minute signals from said 7-segment display unit and from said counter means respectively, into serial pulses distinctly representing hours, 5-minute multiples and minutes respectively, amplifier means for amplifying said serial pulses, and an aural or tactile sensation-producing device to render said pulses audible or palpable.

The invention further provides, in combination with the 7-segment, 12-hour clock unit of a standard electronic timepiece, a device converting pulses generated by said 12-hour clock unit, into a sequence of nonoptical time-indicating signals, comprising a 7-segments-to-binary converter for converting pulses from said 12-hour clock into binary signals representing hours and minutes, a minutes-to-5-minute multiples converter for converting minutes signals from said 7-segments to binary converter into 5-minute multiples and minutes, a parallel binary-to-serial pulse converter for converting parallel hour, 5-minute multiple and minute signals from said 7-segment-to-binary converter and said minutes-to-5-minute multiple converter respectively, into serial pulses distinctly representing hours, 5-minute multiples and minutes respectively, amplifier means for amplifying said serial pulses, and an aural or tactile sensation-producing device to render said pulses audible or palpable.

The 5-minute multiples mentioned in the aforegoing are either quarter hours (fifteen minutes) or tens of minutes.

While from the point of usefulness and convenience these two alternatives are about equivalent, and the electronic circuits involved would not differ in their essentials, the following descriptions and explanations are based on the quarter-hour alternative.

The symbols used are the simplest imaginable and can be understood, learned and memorized within minutes. The hour is represented by a long pulse (dash), quarters of an hour by a double, short pulse (dot-dot), and minutes by a short pulse (dot). Thus, 5:49 would be represented by: — — — — — .. .. .. . . . . that is, 5 hours, 3 quarters, 4 minutes. In the aural embodiment of the invention, a dash pulse would be a single long note, a dot-dot—a double, short note, and a dot—a single, short note. To make recognition even easier, the symbols for the different time units—hours, quarter hours and minutes—would be sounded at different audio frequencies. In the tactile embodiment, a mechanical means, such as a small pin, would be applied against the sensing fingertip, prolonged pressure constituting dashes and short jabs—either double or single—representing double or single dots.

While the device according to the invention is primarily intended for use of the visually handicapped, it could also provide other people, e.g., motorists, machine operators or the like, who cannot afford diverted attention, with a means of ascertaining the time without visual distraction.

While the invention will now be described in connection with certain preferred embodiments, it will be understood that it is not intended to limit the invention to these particularly embodiments. On the contrary, it is intended to cover all alternatives, modifications and equivalent arrangements as may be included within the scope of the invention as defined by the appended claims. Nevertheless, it is believed that embodiments of the invention will be more fully understood from a consideration of the following illustrative description read in conjunction with the accompanying drawings, in which:

Figure 1:
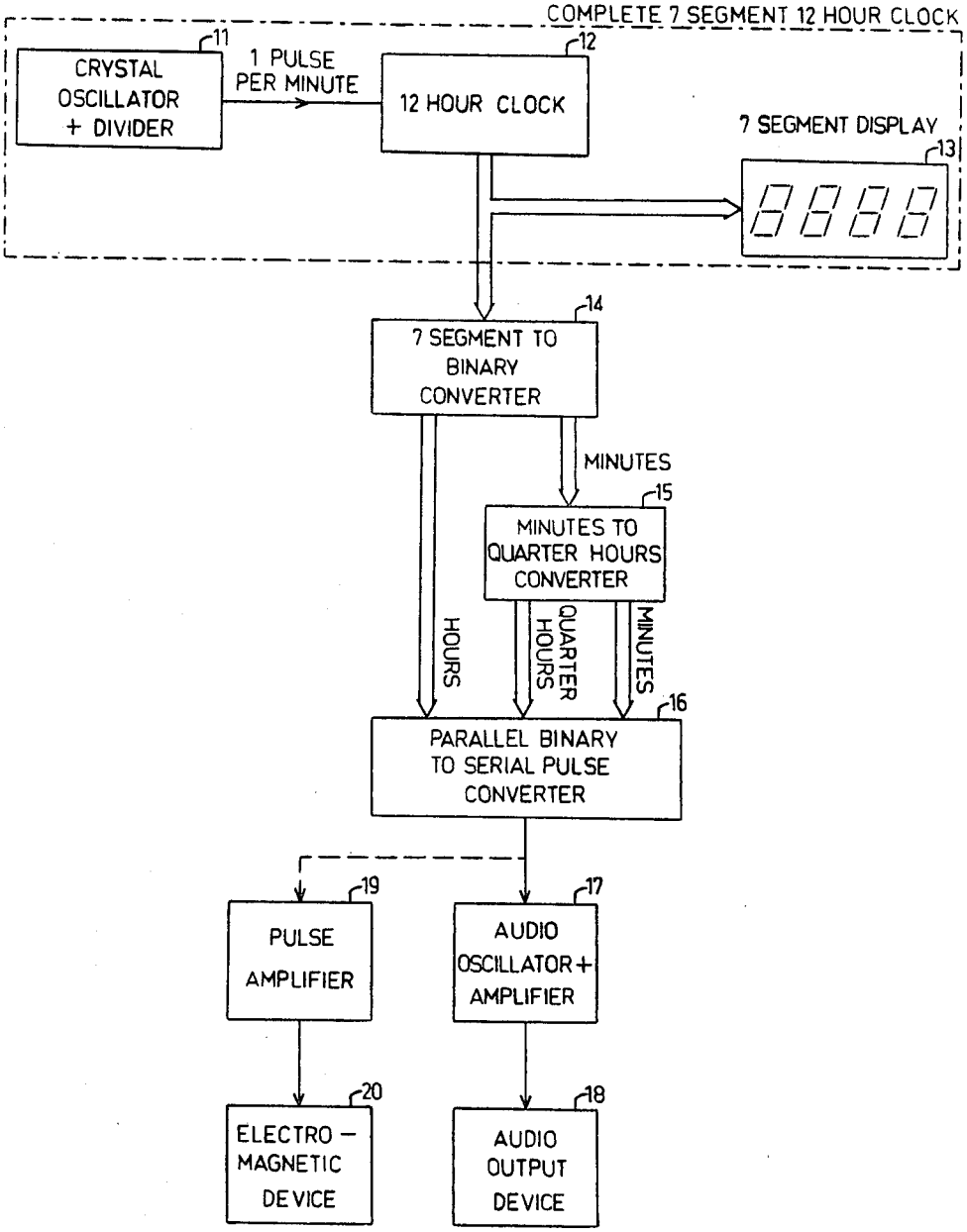
FIG. 1 shows a block diagram of a first embodiment of the invention.

In FIG. 1 there is shown the block diagram of a first embodiment, in which block 1 comprises a crystal oscillator generating HF pulses, and a frequency divider generating a single pulse for a certain number of pulses from the frequency divider. The output of block 1 consists of pulses of a frequency of 1/60 Hz, that is, one pulse per minute.

Block 2 comprises the digital counters required for a digital clock, as well as the converter circuits required to convert the time information from the binary into a 7-segment form. The pulses entering block 2 at a rate of one per minute are counted and summed up, to obtain a self-updating sum of minutes, tens of minutes and hours.

Block 3 consists of four display units, each comprised of a 7-segment arrangement and capable of displaying any of the numerals between zero and nine as a combination of a plurality of all of these 7 segments, in accordance with the information fed from block 2.

Block 4, too, counts the pulses coming from block 1, but in a different way as compared to block 2: it counts the pulses in groups of 15 pulses each, thus obtaining the number of quarter hours. The pulses leaving block 4 represent in a binary form the number of quarter hours as well as the number of excess minutes of the last quarter.

Block 5 receives the pulses leaving block 4 as well as those leaving block 2 and containing binary information on the number of hours. In this manner, block 5 is given the updated time (down to the last minute) as divided into hours, quarters of hours, and minutes.

Block 5 generates a series of successive pulses in the audio range. This series consists of three groups of pulses, each in a different audio frequency, that is, producing a different tone. The number of pulses in each group varies with the time. The first group is compounded of pulses the number of which equals the numbers of hours, the second group consists of pulses of a number equalling the number of quarter hours, and the third group—of pulses equal in number to the number of minutes.

Block 6 is an audio-frequency oscillator which, being fed pulses from block 5, produces corresponding audio signals. After appropriate amplification, these signals are fed to block 7 constituted by a speaker.

In the above-mentioned tactile embodiment of the invention, there is provided a block 8, being a pulse amplifier which delivers the suitably amplified pulses from block 5 to block 9 constituted by an electromagnetic device adapted to move the above-mentioned pin so as to produce the required tactile sensation. Timepieces using the device according to the invention may be optionally equipped either with aural or tactile time indication, or with both.

Figure 2:
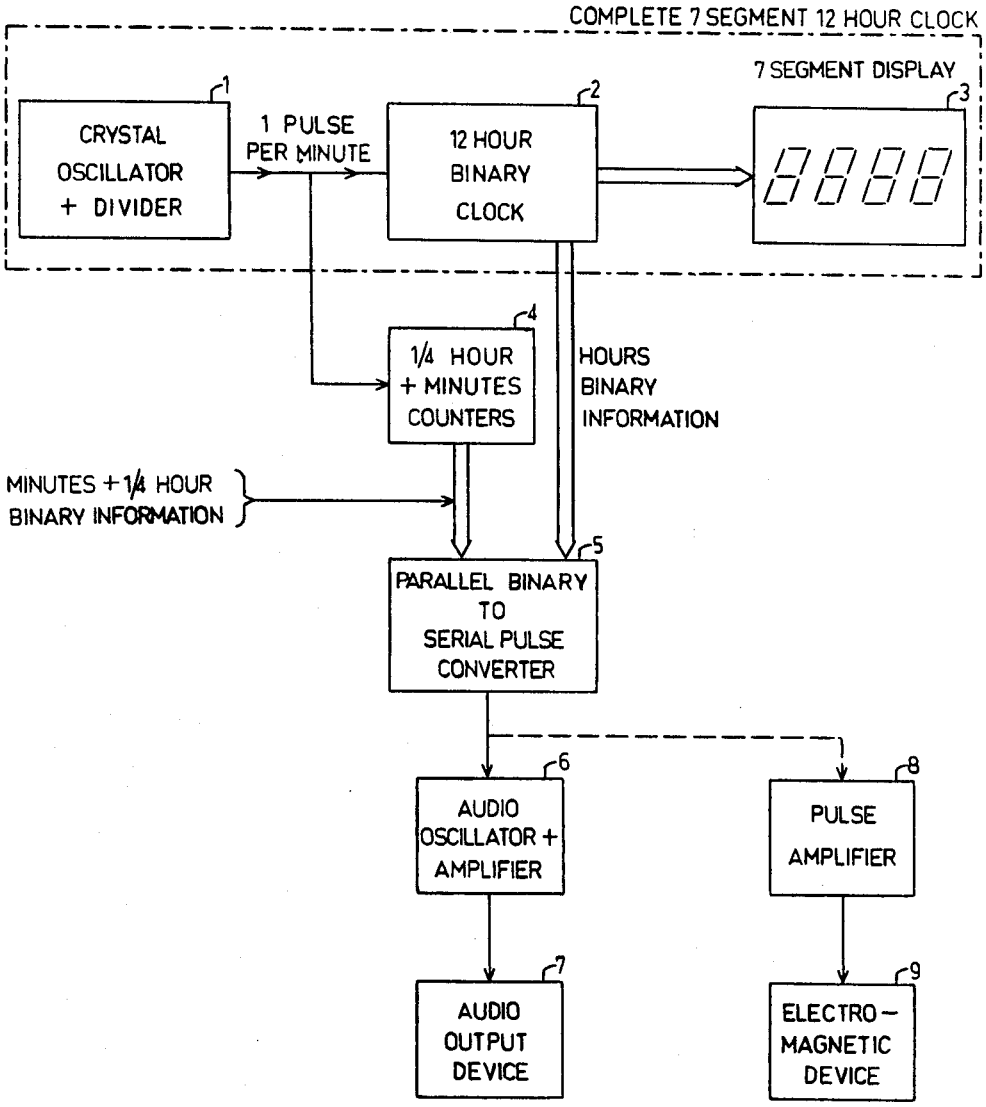
FIG. 2 is a block diagram of another embodiment of the invention.

FIG. 2 shows the block diagram of another embodiment of the invention, in which block 11 is identical with block 1 of FIG. 1. Block 12 is a standard digital timepiece receiving one pulse every minute, adding up the pulses and producing information in the form of hours, tens of minutes and minutes, to be displayed on a 7-segment display unit.

Block 13 is identical with block 3 in FIG. 1.

Block 14 converts the information emerging from block 12 from the 7-segment code to a common binary code. This block produces binary time information in terms of tens of hours, hours, tens of minutes and minutes.

Block 15 is fed binary information from block 14, concerning minutes and tens of minutes, and produces binary information in terms of quarter hours and minutes.

Block 16 is identical with block 5 of FIG. 1; block 17 is identical with block 6 of FIG. 1, block 18 is identical with block 7 of FIG. 1, block 19 is identical with block 8 of FIG. 1, and block 20 is identical with block 9 of FIG. 1.

Figure 3:
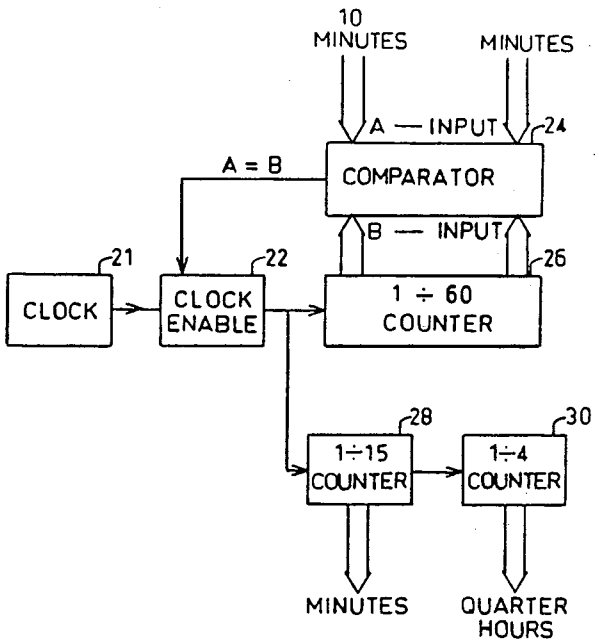
FIG. 3 shows the block diagram of a converter such as block 4 in FIG. 1 and block 15 in FIG. 2.

In FIG. 3 there is seen the block diagram of a minutes-and-tens-of-minutes-to-quarters-of-hour-and-minutes-converter such as block 4 in FIG. 1 and block 15 in FIG. 2.

The diagram shows 6 functional blocks, of which block 21 is a high-frequency oscillator continuously generating pulses.

Block 22 serves as gate for the pulses produced by block 21 and, as will be explained below, blocks or passes these pulses in dependence on the state of block 24.

Block 26 is a digital counter which counts the pulses coming from block 21 and produces a binary number between 1 and 60, in repetitive sequences.

Block 24 is a digital comparator which compares two numbers in binary form. The first number (A) refers to the number of minutes coming from block 14 in FIG. 2. The second number (B) refers to the number produced by the counter of block 26. At the instant B=A, block 24 causes block 22 to block the passage of pulses from block 21. In this manner, the number of pulses leaving from block 21 will always equal the number of minutes.

The pulses produced by block 21 are also led to block 28, a digital counter counting from 0 to 15. Its output is a binary number representing the count, and a single pulse whenever the count arrives at 15. This pulse thus appears once every quarter hour.

Block 30 counts the pulses produced by block 28 and emits their number (which corresponds to the number of quarter hours) in binary form.

Figure 4:
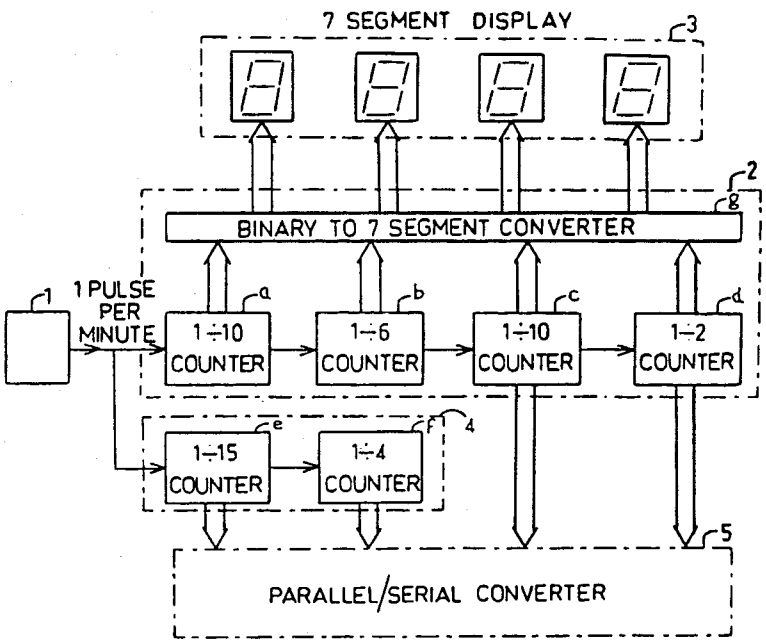
FIG. 4 is a more detailed description of blocks 2, 3 and 4 in FIG. 1.

FIG. 4 is a more detailed description of blocks 2, 3 and 4 of FIG. 1.

Pulses from block 1 enter the counter a in block 2 at a rate of one pulse per minute. This counter produces a binary number representing the number of pulses received by it. After each tenth pulse, counter a produces one pulse, feeding it to counter b and starting to count afresh from zero.

Counter b thus receives one pulse every ten minutes and binarily counts the tens of minutes. After every six pulses, counter b produces a single pulse, feeding it to counter c and starting to count afresh from zero. This single pulse is thus transmitted to counter c once every hour.

In a similar fashion does counter c count the hours (up to ten hours) and produces the number of tens of hours in binary form, transmitting to counter d one pulse per every ten hours.

Counter d produces the number of ten-hour groups in a binary fashion.

The binary outputs of the four counters a, b, c, d are fed to a converter g which converts binary code into 7-segment display code. This converter thus renders the time information suitable for feeding into the 7-segment display unit.

The pulses coming from block 1 at a rate of one per minute also enter counter e. This counter counts the minutes for each quarter hour and produces their number in binary form once every 15 minutes (once every quarter hour), delivering a pulse to counter f, and starts counting afresh from zero.

Counter f counts the quarter hours and delivers their number in binary form.

Figure 5:
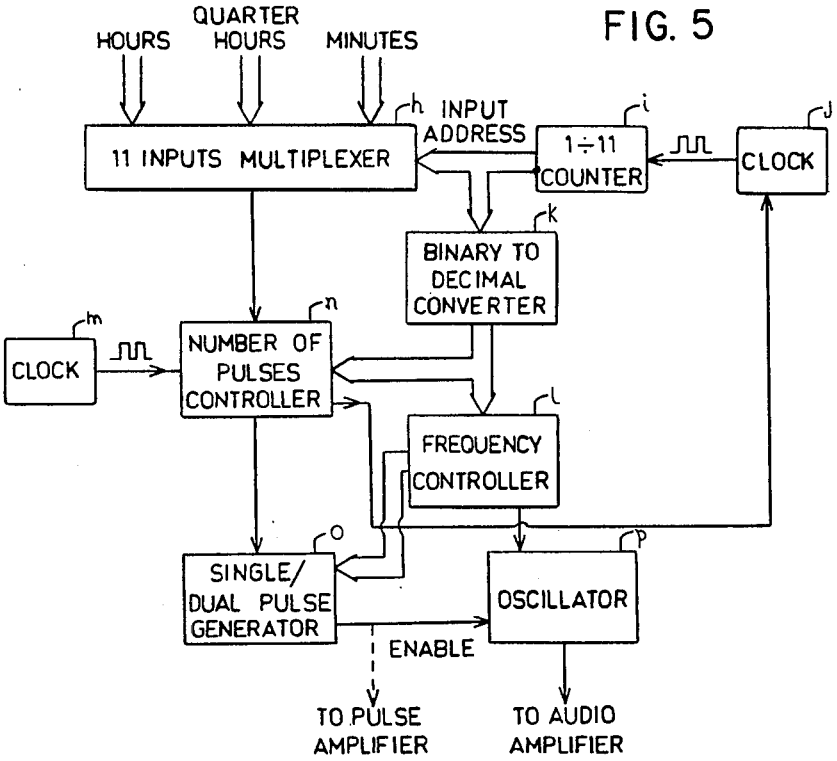
FIG. 5 is a more detailed block diagram of the converter of FIG. 3.

FIG. 5 is a more detailed block diagram of the parallel binary-to-serial pulse-converter (block 5 in FIG. 1, block 16 in FIG. 2).

The diagram comprises nine functional blocks.

Block h is a multiplexer having 11 inputs (corresponding to the total number of bits of all binary inputs into the converter) and one output. A binary number addressed to it from block i determines which of the 11 inputs will be connected to the output of h. Block i is a decade counter which counts the pulses of the oscillator or clock j. The output of block i is a binary number which serves for addressing block h.

Figure 6:
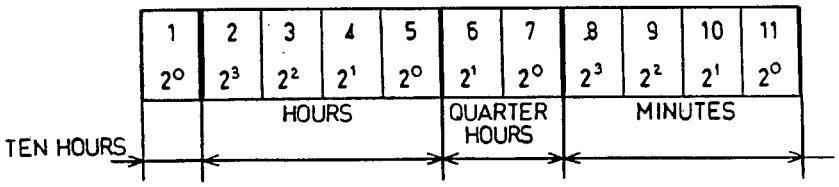
FIG. 6 is a schematic representation of the multiplexer of FIG. 5.

Each bit of the binary numbers entering the converter has the value of $2^n$, with possible n-values varying between 0 and 3 (see FIG. 6).

The tens of hours are represented by a single bit entering block h at input No. 1. When this bit is "1", the device must sound 10 audio-frequency pulses. The remaining 10 bits are entered into the multiplexer in the following order: hours at inputs 2 to 5; quarter hours at inputs 6, 7; minutes at inputs 8–11. Input 1 thus means 10 pulses to be provided by the clock. Analogously, inputs 2 and 8 (n=3) will result in 8 pulses; inputs 3 and 9 (n=2) will give 4 pulses; inputs 4, 6, 10 mean 2 pulses, and inputs 5, 7, 11—1 pulse each.

Block k decodes the binary address of the prevailing input (out of 11 inputs) which is transferred to the output of block h and sorts the addresses according to two criteria:

(a) Number of pulses as representing clock time;

(b) Audio frequency of pulses, as representing hours, quarter hours and minutes.

Block 1 is a network of resistors which determine the audio frequency of the pulses delivered by the device. This frequency differs for hours, quarter hours and minutes and is determined according to the above criterion (b).

Block m is an oscillator generating LF-pulses.

Block n determines the number of pulses that will pass from oscillator m for each one of the 11 inputs of block h. This is done according to the above criterion (a).

Block o is a pulse generator which produces a single or a double pulse for code pulse from block n, depending on the state of block l: a single long pulse for hours, a single short pulse for minutes and two short pulses, that is a double pulse, for quarter hours.

Figure 7:
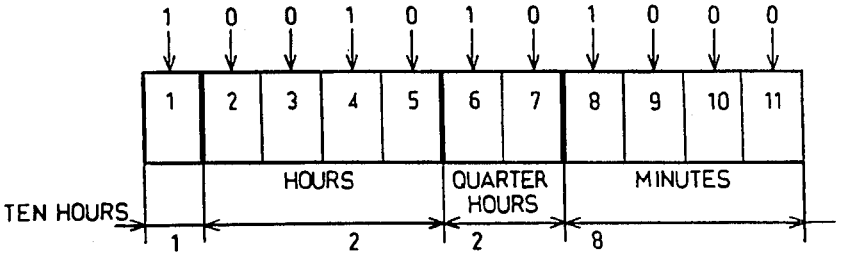
FIG. 7 shows the multiplexer of FIG. 6, with inputs corresponding to the clock time of 12:38.

Example: Let the time be 12:38; inputs to block h will then be as shown in FIG. 7.

When counter i delivers address No. 1, output of block h will be logic "1" (as in input 1). Block k now decodes the address and orders block n to pass 10 audio pulses. At the same time, block k orders the audio frequency to be determined according to that set for hours.

The pulses having been sounded according to each input of block h, oscillator j delivers one pulse to counter i and the block h address advances to the next input. In the above example (12:38, see FIG. 7) the next two inputs are logic "0" and, therefore, no pulses will be produced. The next address comprises a logic "1" and the device will sound two more pulses in the hour audio frequency, altogether now 12.

When the inputs 6 and 7 are addressed, the number-of-pulses controller n will deliver to the pulse generator o a number of pulses appropriate to the above criterion a. In the given example (12:38), there will be two such pulses, indicating 2 quarter hours (=30 min.). Following the same procedure, the controller n will now deliver 8 pulses for the minutes, altogether now 30+8=38 minutes.

Block l, the frequency controller, changes the frequency of the oscillator p according to the information prevailing at any instant. The pulse generator o facilitates the sounding of the time signal either as a single event ("dash" for each hour and "dot" for each minute) or as a double event ("dot-dot" for quarter hours). The output of oscillator p leads to the audio amplifier 6 or 17 of FIGS. 1 and 2 respectively, while the signal to actuate the optional electromagnetic device 9 or 20 of FIGS. 1 and 2 respectively is taken from the output of pulse generator o.

Figure 8:
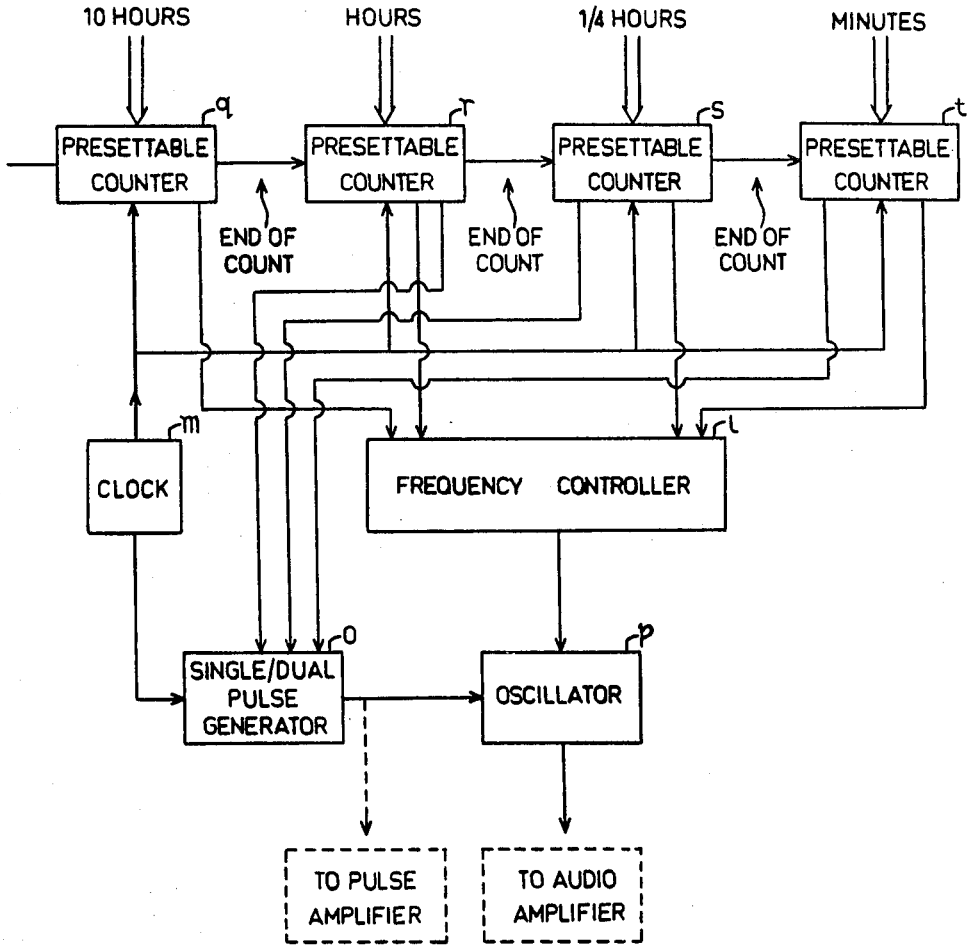
FIG. 8 is a block diagram of another embodiment of the parallel binary-to-serial pulse converter.

In FIG. 8 there is seen a block diagram of another embodiment of the parallel binary-to-serial pulse-converter (block 5 in FIG. 1 and block 16 in FIG. 2).

Each of the four blocks q, r, s, t is a counter charged in parallel. A counter of this type counts clock pulses backwards, that is, it starts counting from a preset value and counts backwards to 0. When it arrives at 0, it delivers a pulse.

Counter q is precharged to a value appropriate to the number of hours in the ten-hour slot, that is either 10 or 0. If charged to ten hours, it will count 10 pulses and then stop. If charged to 0, it will not count at all. When it has stopped counting, it causes counter r to start counting.

Counter r is precharged to the number of single hours and generates pulses corresponding to this number. Having produced this number of pulses, it orders counter s to start counting and also causes a change in the frequency of the oscillator in order to produce the audio signals representing the quarter hours.

Counter s is precharged to the number of quarter hours. Having stopped producing pulses according to this number, it orders counter t to start counting and also causes a change in the frequency of the oscillator in order to produce the audio signal for the minutes.

Counter t is precharged to the number of minutes. This number of pulses having been produced, the device concludes its reaction to the present call.

Through its control input, pulse generator o is informed as to which counter is counting at any instant. Depending on this information, the generator will produce a single, long pulse ("dash") for each pulse of the clock m whenever the hour counters operate, two short, close pulses ("dot-dot") when the quarter-hour counter operates and one short pulse ("dot") when the minutes counter operates.

The pulses emitted by the generator o enable the oscillator p whenever they are in the "1"-state. Therefore, a single pulse of a certain frequency and duration will be sounded for every hour ("dash") a single pulse of a second frequency and shorter duration for every minute ("dot") and a double pulse of a third frequency and shorter duration, for every quarter hour ("dot-dot").

For aesthetic effect, the above three frequencies could stand in a ratio of 1:5/4:3/2 (or 4:5:6), which would result in the sounds of a common chord (major triad), or in a ratio of 1:3/2:2 (or 4:6:8), giving a tonic, its fifth and its octave.

Figure 9:
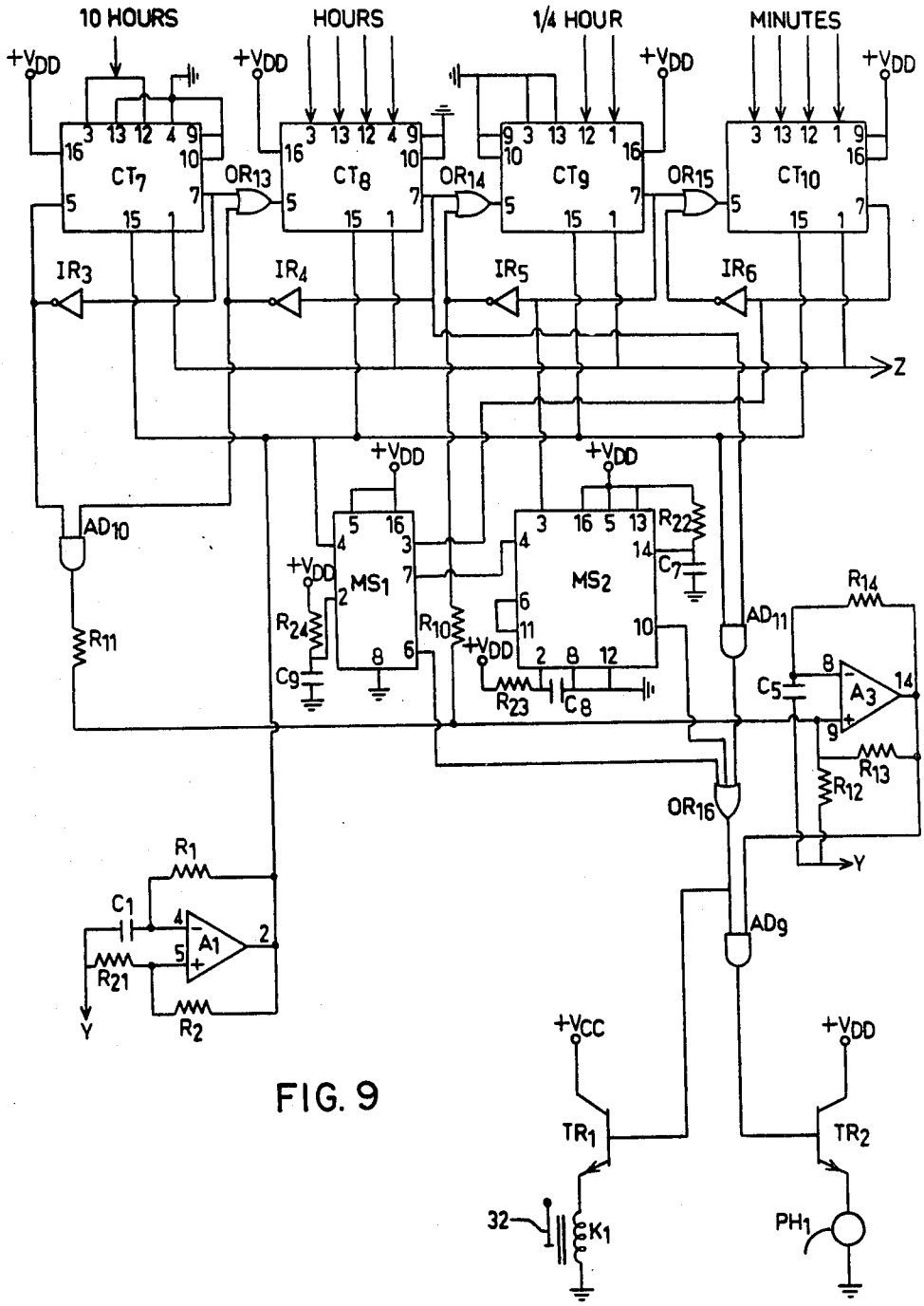
FIG. 9 is a more detailed circuit diagram of the embodiment shown shematically in FIG. 8.

FIG. 9 is a more detailed circuit diagram of the embodiment shown schematically in FIG. 8.

Counter CT7 is counting down (backwards), because its terminal 10 is grounded. It is charged to a number from which it must start to count via its terminals 3, 13, 12, 4. CT7 is required to start counting from 10 or 0, therefore it must handle only the inputs 1010 (=10) or 0000 (32 0). This is done by permanently grounding terminals 13, 4, i.e., rendering them logic "0". Terminals 3, 12 are together connected to the ten-hour input and will become logic "1" only if the time is 10 or more.

When counter CT7 has counted down to 0, its terminal 7 changes from logic "1" to logic "0". Terminal 7 of counter CT8 is, however, still logic "1", as it has not yet reached logic "0" (not having yet started to count). Therefore, output $IR_4$ is "0", and so is output OR-gate $OR_{13}$. This is a sign for CT8 to start counting, counting down from the number it was charged to, until 0. When it reaches 0, voltage in its terminal 7 drops to "0", therefore the voltage at the output of inverter $IR_4$ will rise to "1". This will result in the voltage at the output of $OR_{13}$ to attain "1", causing CT8 to stop counting.

When one or both inputs of AND-gate $AD_{10}$ are at a voltage level "0", resistor $R_{11}$ will be connected to voltage 0 via output of $AD_{10}$. When both inputs are in state "1", $R_{11}$ will be on positive voltage. To the other terminal of $R_{11}$ there is connected audio oscillator $A_3$, the frequency of which is determined by the voltage at the upper end of $R_{11}$. When both CT7 and CT8 have finished counting, the voltage at the upper end of $R_{11}$ has risen and the oscillator frequency has changed, being now appropriate to the quarter-hour sound.

CT9 is charged to the number of quarter hours, that is, 0, 1, 2, or 3. To this end it is sufficient to charge it through two binary inputs, the rest are shortened to ground. When CT9 has counted down to 0, OR-gate $OR_{14}$ will cause it to stop counting. At the same time, the voltage at the output of $IR_5$ and at the upper end of $R_{10}$ rises, which affects the oscillator frequency, setting it to the minute sound.

$CT_{10}$ is charged to the number of minutes and counts down. When it arrives at 0, the voltage at $IR_6$ rises (due to falling voltage in terminal 7 of CT10) and $OR_{15}$ causes CT10 to stop counting. The voltage decrease in terminal 7 causes $AD_9$ to stop passing the audio frequency from oscillator $A_3$.

$A_1$ is an oscillator working at a frequency much lower than that of $A_3$. When the voltage at its output is positive, $AD_9$ passes the audio frequency. In this way, the sound heard will not be continuous, but intermittent, that is, as pulses.

Transistor $TR_2$ amplifies the weak current from $AD_9$ to a level sufficently high to operate the speaker $PH_1$ which produces the sound.

MS1 is a monostable circuit producing a short pulse the instant a pulse arrives from $A_1$. MS2 comprises two monostables, the first of which causes the second to deliver a short pulse (LIKE MS1) after a short delay from the instant MS1 has concluded its pulse. MS2 is rendered inoperative when counter CT9 has finished counting, a situation resulting in a single short pulse. MS1 is inoperative when counter CT10 has finished counting. The clock pulse ($A_1$) is passed via $AD_{11}$ only when CT7 or CT8 are counting. The outputs of MS1, MS2 and $AD_{11}$ are summed up via $OR_{16}$ so that the pulse or pulses appropriate to the counter operating at any instant are passed from $OR_{16}$ to the next stage.

At the output of $OR_{16}$ there will appear a long pulse ("dash") (from $A_1$) when CT7 or CT8 are counting. When CT9 is counting, two short pulses ("dot-dot") will appear at the output of $AD_{11}$, and when CT10 counts, a single short pulse ("dot") will appear.

With the aid of $AD_9$, these pulses permit the sounding of the audio frequencies of oscillator $A_3$. These pulses also actuate the electromechanical device $K_1$ which pushes out a thin pin 32 when transistor $TR_1$ receives the pulse from $AD_{11}$, causing the tactile sensation that permits the user to "feel" the time.

Figure 10:
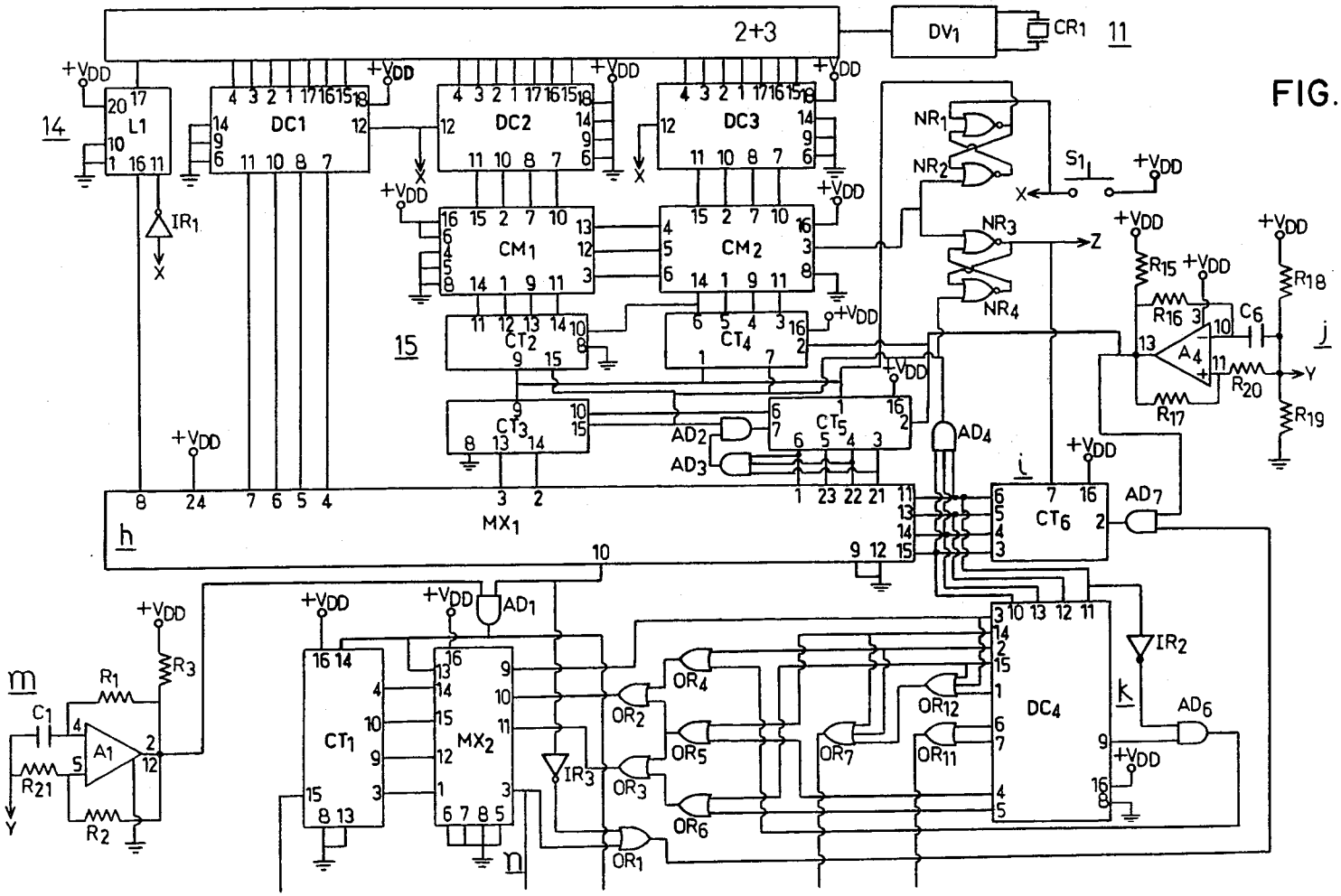
FIG. 10 is a detailed circuit diagram of the device according to the invention, including a CALL circuit.
Figure 10:
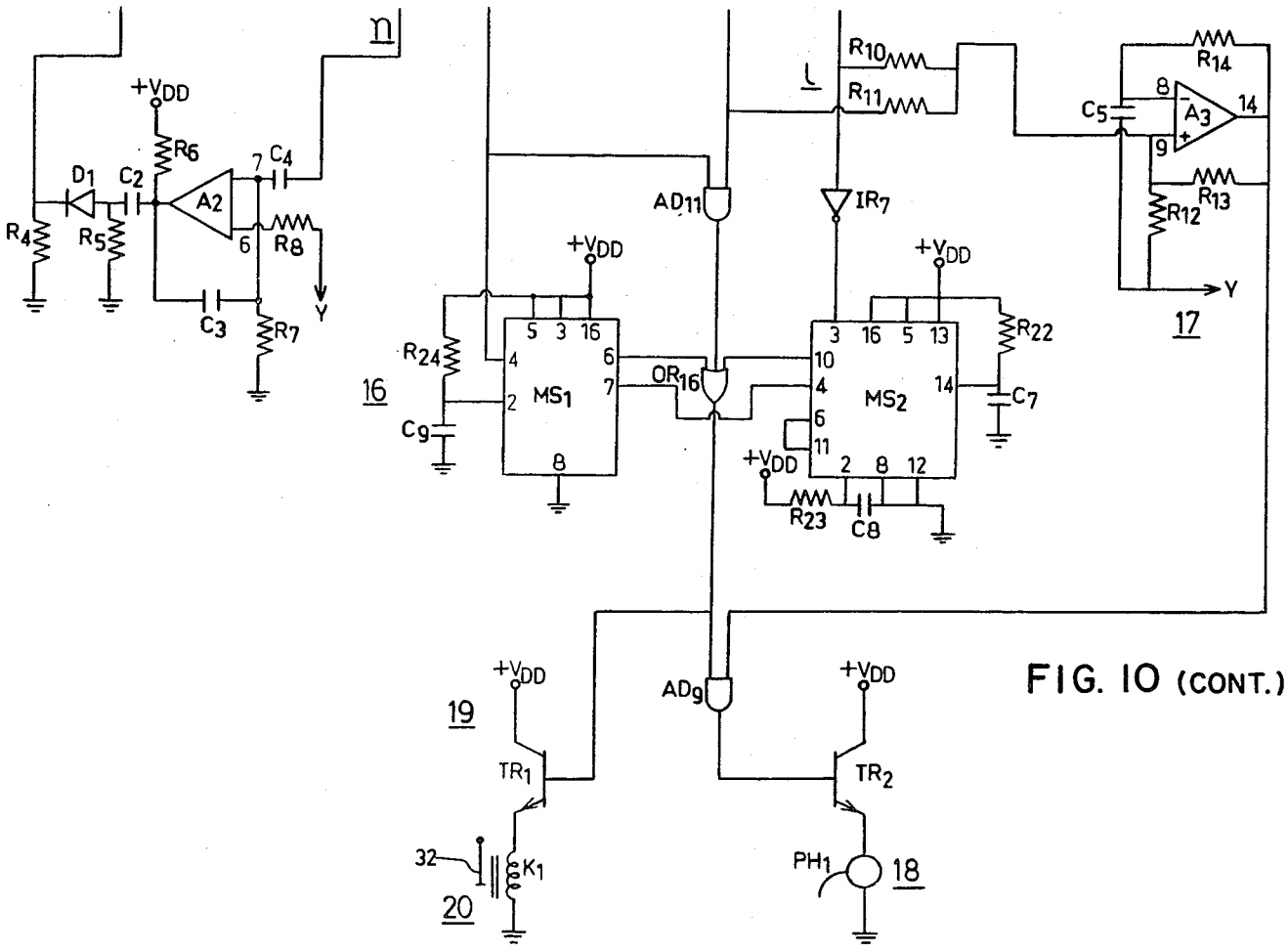

FIG. 10 shows a circuit diagram of the device according to the invention, including the CALL circuit.

When switch $S_1$ is pressed (CALL action), the following happens:

1. The system of gates $NR_1$, $NR_2$ which operate as a bistable multivibrator, changes its state: output $NR_1$ which was logic "1", turns logic "0".

2. $L_1$, $DC_1$, $DC_2$, $DC_3$ are signaled by switch $S_1$ to read the state of the clock at the instant switch $S_1$ was pressed (CALL).

3. Counters CT2, CT3, CT4, CT5 are signaled by $NR_1$ to start counting, to convert the minutes and tens of minutes into minutes and quarter hours.

4. When this conversion is completed, voltage in the output of $CM_2$ rises from "0" to "1". This rise changes the state of $NR_1$ to logic "0" as it was before, and therefore counters CT2, CT3, CT4, CT5 stop the conversion.

5. Gates $NR_3$, $NR_4$ are also arranged as bistable multivibrators and a voltage rise at the output of $CM_2$ changes their state as well. Output of $NR_3$ (Point z) drops from "1" to "0" . This enables counter CT6, initiating the process of converting the time into audio pulses.

6. When this conversion process is finished, CT6 is at address 11. At this stage, the output of $AD_4$ rises from "0" to "1", and $NR_3$ returns to its initial state. Point z rises to "1" and conversion into pulses will stop. At this stage all activities relating to CALL are concluded and the circuit reverts to its initial stage, ready for the next CALL.

The following is a detailed description of the operation of the converter shown as block diagram in FIG. 5 and, in, greater detail, in the circuit diagram of FIG. 10.

$A_4$ is an oscillator (that is, a pulse generator) the output of which feeds the counter CT6 via $AD_7$. When the process of converting the time into hours, quarter hours and minutes is completed, $AD_7$ opens and CT6 starts counting the pulses of $A_4$. Upon counting one pulse, its outputs will be 0001, and multiplexer $MX_1$ will connect its first input (terminal 8) to its output (terminal 10). When the input is "1", $AD_1$ will pass the pulse from oscillator $A_1$. When the input is "0", the pulse will not pass.

$DC_4$, too, is fed the output of CT6. If the latter is 0001, the terminal 14 of $DC_4$ will be on level "1", the remainder being on "0". In a similar manner, only one of its terminals will be on level "1" for each address it receives from CT6. In gates $OR_2$–$OR_6$ a certain binary word is formed for every possible output voltage of $DC_4$. This binary word enters as address into $MX_2$. The latter is a multiplexer which, for each sampling, transfers the value of one of its inputs to the output. The input is determined according to the addresses being introduced into it by $DC_4$ and from the gates $OR_2$–$OR_6$.

$A_1$ is an oscillator producing LF-pulses, eventually to be used for the time call-out. The value of the $MX_2$ inputs is determined by the output of the counter CT1. This counter counts the pulses of $A_1$ which pass the gate $AD_1$ if the output of $MX_1$ is on "1". The outputs of CT1 change their state in dependence on the number of pulses counted, therefore, terminal 4 of CT1 will be "0" until CT1 will have counted 2 pulses, after which it will pass into state "1". Terminal 10 will change to state "1" only after CT1 will have counted 4 pulses, terminal 9—after 8 pulses and terminal 3—after 10 pulses.

The output of $MX_2$ (terminal 3) will be on "0" until the value of the input connected to it at that particular instant will become "1". For example: if the address of $MX_2$ is 011, terminal 3 of $MX_2$ will be "0", until CT1 will have counted 4 pulses. When terminal 3 will have risen to "1", the monostable $A_2$ will be caused to deliver a reset pulse to counter CT1 via $D_1$, $C_2$, $R_4$, $R_5$, returning CT1 to zero to enable the latter to start counting again. The address inputs of $MX_2$ are arranged in such a way that the number of pulses counted by CT1 will always be equal to the value presented by the appropriate binary input in $MX_1$.

$OR_1$ will enable $AD_7$ to pass an additional pulse to CT6 only when terminal 3 of $MX_2$ is in the "1" state (that is, when CT1 has counted to the value appropriate to the input which, at that instant, is connected to the $MX_1$ outputs) or when the $MX_1$ output is "0" (that is, when the input connected to the $MX_1$ output at that instant, is "0"). The subsequent pulse entering the CT6 will change the address for $MX_1$ and will connect to its output the next input.

For each one of the CT6 addresses connected to the hours input of the $MX_1$, $R_{11}$ will be connected to positive voltage via $OR_7$, $OR_{12}$, in order to determine, in oscillator $A_3$, the appropriate frequency for the hour call-out. For the quarter-hour inputs in the $MX_1$, the resistor $R_{10}$ will be connected to positive voltage via $OR_{11}$, to obtain an appropriate frequency for the quarter-hour call-out. For the minute inputs in the $MX_1$, none of the two resistors will be put on positive voltage and the frequency of oscillator $A_3$ will be appropriate for the minute call-out.

$MS_1$ is a monostable circuit producing a short pulse at the instant of formation of each pulse coming from $A_1$. $MS_2$ comprises two monostable elements, the first receiving the pulse from $MS_1$ and, after a short delay, exciting the second element to produce an identical pulse. In this manner, two short pulses are obtained for the quarter hours. $MS_2$ is enabled only for addresses 6, 7 in $MX_1$, that is, only for quarter hours. Subsequently, the output of $OR_{11}$ blocks $MS_2$, while $MS_1$ continues to produce single, short pulses for the minutes.

The output of oscillator $A_1$ which generates long pulses to indicate hours is passed through $AD_{11}$ only for addresses 1–5 of $MX_1$, that is, only for hours. From $AD_{11}$, these pulses are passed through gate $OR_{16}$, together with the shorter pulses from $MS_1$ and $MS_2$. As long as the long pulse is present, the output of $OR_{16}$ will be positive, regardless of the shorter pulses. As soon as the long pulse fails to pass $AD_{11}$, only the short pulses will appear at the output of $OR_{16}$.

With the help of $AD_g$, the pulses emerging from $OR_{16}$ enable oscillator $A_3$ to produce the audio frequencies. These pulses also actuate the electromechanical device $K_1$.

By way of a non-limiting example, there is given in the following a list of components and their respective values for the circuit diagram shown in FIG. 10. The catalog numbers refer to products of National Semiconductor Corp.

| | |
|---|---|
| $A_{1-4}$ | ¼ MM74C909 |
| $AD_{1,2,6,7,9,10}$ | ¼ MM74C08 |
| $AD_{3,4,11}$ | ½ CD4073BM |
| $CT_1$ | CD 40 17 BM |
| $CT_{2,4,6}$ | ½ CD 4518 BM |
| $CT_{3,5}$ | ½ CD 4520 BM |
| $CT_{7-10}$ | CD 40 29 BM |
| $CM_{1,2}$ | MM 74C85 |
| $CLK_{2+3}$ | MM 5385 |
| $CR_1$ | CRYSTAL, 3.58 MHz |
| $D_1$ | 1N914 |
| $DC_{1-3}$ | MM 74C915 |
| $DC_4$ | CD 4028 BM |
| $DV_1$ | MM 5369 |
| $IR_{1-7}$ | 1/6 MM 74C04 |
| $L_1$ | MM 74C373 |
| $MS_1$, $MS_2$ | CD 4528 |
| $MX_1$ | MM 74C150 |
| $MX_2$ | CD 4051 BM |
| $NR_{1-4}$ | ¼ MM 74C02 |
| $OR_{1-6,11,13-16}$ | ¼ MM 74C32 |
| $OR_{7,12}$ | ½ CD 4075 BM |
| $TR_{1,2}$ | 2N2222 |
| $C_{1,3,4}$ | 0.01 uf |
| $C_{2,5,6}$ | 1000 pf |
| $C_{7,8,9}$ | 0.1 uf |
| $R_{1,2,5,8,18,19}$ | 10 KΩ |
| $R_{3,6,15,21}$ | 5.1 KΩ |
| $R_7$ | 1 KΩ |
| $R_{13,14,16,17,4}$ | 160 KΩ |
| $R_{10,11,12,20,22,23,24}$ | 910 KΩ |

It will be evident to those skilled in the art that the invention is not limited to the details of the foregoing illustrative embodiments and that the present invention may be embodied in other specific forms without departing from the essential attributes thereof, and it is, therefore, desired that the present embodiments be considered in all respects as illustrative and not restrictive, reference being made to the appended claims, rather than to the foregoing description, in which it is intended to claim all modifications coming within the scope of the invention.

What is claimed is:

1. In combination with the 7-segment, 12-hour clock unit of an electronic timepiece providing output pulses in terms of minutes, tens of minutes and hours, a device converting pulses generated by said 12-hour clock unit, into a sequence of nonoptical time-indicating signals, comprising binary counter means fed by said output pulses for counting minutes and groups of 5-minute multiples each, a parallel binary-to-serial pulse converter for converting the parallel hour signals from said unit, and 5-minute-multiple and minute signals from said counter means, into serial pulses distinctly representing hours, 5-minute multiples and minutes respectively, amplifier means for amplifying said serial pulses, and a nonoptical time-indicating device to render said pulses appreciable.

2. In combination with the 7-segment, 12-hour clock unit of an electronic timepiece providing output pulses in terms of minutes, tens of minutes and hours, a device converting pulses generated by said 12-hour clock unit, into a sequence of nonoptical time-indicating signals, comprising a 7-segments-to-binary converter for converting pulses from said 12-hour clock unit into binary signals representing hours and minutes, a minutes-to-five minute multiples converter for converting minutes signals from said 7-segments to binary converter into 5-minute multiples and minutes, a parallel binary-to-serial pulse converter for converting parallel hour, 5-minute-multiple and minute signals from said 7-segment-to-binary converter and said minutes-to-5 minute multiples converter respectively, into serial pulses distinctly representing hours, 5-minute multiples and minutes respectively, amplifier means for amplifying said serial pulses, and a nonoptical time indicating device to render said pulses appreciable.

3. The device as claimed in claim 1, wherein said groups of 5-minute multiples each, as counted by said binary counter, are groups of fifteen minutes each, said 5-minute-multiple signals are quarter-hour signals, and said 5-minute multiples represented by said serial pulses are quarter hours.

4. The device as claimed in claim 2, wherein said 5-minute multiples are quarter hours.

5. The device as claimed in claim 1, wherein said group of 5-minute multiples each, as counted by said binary counter, are groups of ten minutes each, said 5-minute-multiple signals are tens-of-minutes signals, and said 5-minute multiples represented by said serial pulses are tens of minutes.

6. The device as claimed in claim 2, wherein said 5-minute multiples are tens of minutes.

7. The device as claimed in claim 1 or 2, wherein said nonoptical time-indicating signals are sequences of audible pulses of different length, spacing, and audio frequency.

8. The device as claimed in claim 7, wherein said pulses are audible and are dash-like for hours, double-dot-like for 5-minute multiples and dot-like for minutes, the audio frequency of the dash-like pulses being the lowest, and the audio frequency of the dot-like pulses being the highest, and wherein the time is ascertained by counting the dashes for hours, the double-dots for 5-minute multiples and the dots for minutes.

9. The device as claimed in claims 1 or 2, wherein said nonoptical time-indicating signals are sequences of palpable pulses of different length and spacing.

10. The device as claimed in claim 9, wherein said pulses are palpable and are dash-like for hours, double-dot-like for 5-minute multiples and dot-like for minutes, and wherein the time is ascertained by counting the dashes for hours, the double-dots for 5-minute multiples and the dots for minutes.

11. The device as claimed in claim 1 or 2 wherein said nonoptical time indicating device comprises a speaker.

12. The device as claimed in claims 1 or 2, wherein said nonoptical time indicating device comprises a projection accessible to the user's fingertip and an electromagnetic arrangement which, in response to said serial pulses, causes said projection to perform a reciprocating movement, whereby, via his tactile sense, said user is enabled to perceive said time indicating signals.

* * * * *

UNITED STATES PATENT AND TRADEMARK OFFICE

CERTIFICATE OF CORRECTION

PATENT NO. : 4,472,065

DATED : September 18, 1984

INVENTOR(S) : Goodman

It is certified that error appears in the above-identified patent and that said Letters Patent is hereby corrected as shown below:

In column 3, line 34, delete "shematically" and substitute therefore --schematically--.

In column 6, line 3, delete "1" and substitute therefore --l--.

In column 7, line 40, delete "32" and substitute therefore --(= --.

In column 8, line 22, delete "LIKE" and substitute therefore --like--.

In column 10, line 24, delete subscript "g" of "AD" and substitute therefore subscript --9--.

UNITED STATES PATENT AND TRADEMARK OFFICE

CERTIFICATE OF CORRECTION

PATENT NO. : 4,472,065

DATED : September 18, 1984

INVENTOR(S) : Goodman

It is certified that error appears in the above-identified patent and that said Letters Patent is hereby corrected as shown below:

IN THE DRAWING FIGURES:

On sheet 1 of 8, delete"FIG. 1" and substitute therefore --FIG. 2--.

On sheet 2 of 8, delete "Fig. 2" and substitute therefore --Fig. 1--.

On sheet 7 of 8, FIG. 10, delete the line indicating a connection between leads at 18 and 14 of the device labeled "DC2". This line should be deleted so that the connections are identical to those of "DC3."

Signed and Sealed this

*Sixteenth* Day of *July 1985*

[SEAL]

*Attest:*

DONALD J. QUIGG

*Attesting Officer* *Acting Commissioner of Patents and Trademarks*